United States Patent [19]

Shaw

[11] 4,257,795

[45] Mar. 24, 1981

[54] COMPRESSOR HEAT PUMP SYSTEM WITH MAXIMUM AND MINIMUM EVAPORATOR ΔT CONTROL

[75] Inventor: David N. Shaw, Unionville, Conn.

[73] Assignee: Dunham-Bush, Inc., West Hartford, Conn.

[21] Appl. No.: 893,863

[22] Filed: Apr. 6, 1978

[51] Int. Cl.[3] ..... F25D 21/00; F25B 41/00; F25B 1/00

[52] U.S. Cl. ..... 62/150; 62/209; 62/228

[58] Field of Search ..... 62/150, 156, 228 C, 62/209, 227, 151, 160, 159; 165/29

[56] References Cited

U.S. PATENT DOCUMENTS

| | | | |
|---|---|---|---|
| 2,068,689 | 1/1937 | Miller | 62/227 X |
| 2,191,967 | 2/1940 | Miller | 62/227 X |
| 3,350,896 | 11/1967 | Harnish | 62/228 C X |
| 3,447,335 | 6/1969 | Ruff et al. | 62/159 |
| 3,466,888 | 9/1969 | Kyle | 62/160 X |
| 3,474,639 | 10/1969 | Smith | 62/160 |
| 4,102,391 | 7/1978 | Noland et al. | 165/29 |

*Primary Examiner*—William E. Wayner
*Assistant Examiner*—Harry Tanner
*Attorney, Agent, or Firm*—Sughrue, Rothwell, Mion, Zinn and Macpeak

[57] ABSTRACT

An air source heat pump system incorporating a refrigerant charged bulb within the air flow passing over the outdoor coil of the heat pump system to sense outside ambient air temperature. The refrigerant charged bulb supplies a variable saturated pressure which acts upon a bellows of a control unit whose opposite side is subjected via a second bellows to saturated suction pressure (corresponding to refrigerant evaporating temperature) of the refrigerant returning from the outdoor coil to the inlet of the compressor. The bellows provides a spring load. An electrical switching device responsive to this pressure differential acts to first block unnecessary loading of the compressor and secondly to initiate unloading of the compressor. Additional switching means prevents excessive unloading of the compressor and insures subsequent initiation of loading to prevent liquid logging of the evaporator coil.

10 Claims, 2 Drawing Figures

COMPRESSOR HEAT PUMP SYSTEM WITH MAXIMUM AND MINIMUM EVAPORATOR ΔT CONTROL

BACKGROUND OF THE INVENTION

1. Field of the Invention

This invention relates to heat pumps, and more particularly, to a heat pump system involving simplified controls for maximizing system coefficient of performance, while insuring that safe operating limits are not exceeded.

2. Description Of The Prior Art

Heat pump systems comprise indoor and outdoor coils within a refrigeration loop including a compressor, with the coils trading functions as condensor and evaporator depending upon requirements for heating or cooling of the enclosure housing the indoor coil. Thus, during heating mode, the outdoor coil constitutes an air source evaporator, and the indoor coil acts as a condensor to heat the enclosure, while during the cooling mode, the indoor coil becomes a system evaporator and the outdoor coil becomes the air source condensor. The present invention is concerned with achieving a high coefficient of performance for a heat pump system when the system is operating under heating mode, and the outdoor coil acts as the system evaporator and the indoor coil as the system condensor.

Sometimes there occurs a situation where the heat pump systme operates over extended periods with great differences between the coil surface temperature and with the ambient temperature above that which is necessary for effective heating of the building when the system is under heating mode. This is also important in terms of the number of defrost cycles required to defrost the outdoor coil which functions as the evaporator for the system.

It is therefore an object of the present invention to provide a heat pump control system wherein the saturated suction pressure to the compressor is never allowed to fall further than that which is necessary to adequately heat the building in question and which prevents the saturated condensing pressure from exceeding that which is necessary to adequately heat the building under steadystate conditions.

It is a further objection of this invention to provide an improved air source heat pump system in which the coefficient of performance of the heat pump system is maximized at operating conditions.

It is a further object of the present invention to provide an improved air source heat pump system in which the coil surface temperature is prevented from dropping below the dew point or wet bulb temperature so that, under most conditions, no frosting occurs on the outdoor coil acting as the evaporator for the system, and to virtually eliminate the necessity for defrosting.

SUMMARY OF THE INVENTION

The present invention is directed to an air source heat pump system of the type including a first heat exchanger forming an indoor coil, a second heat exchanger forming an outdoor coil, and preferably positioned in heat exchange relation to the ambient air, a compressor, and conduit means carrying a refrigerant and connecting said compressor between said coils and in a closed series loop. An expansion valve or capillary tube is provided within the conduit means adjacent to the inlet end of the outdoor coil to permit the outdoor coil to act as an evaporator when the system is in a heating mode. Means are provided for loading and unloading the compressor to effect capacity control of the compressor. The improvement comprises a bulb positioned adjacent the outdoor coil and within the ambient air flow passing over the outdoor coil, with the bulb carrying a mass of refrigerant corresponding to that within said conduit means. The bulb and said conduit means, at a point intermediate the outside coil and the inlet to the compressor, are connected to a sensor for comparing the ambient temperature at the outside coil to the saturated suction or evaporating temperature of the refrigerant at the outdoor coil, available to the compressor. Control means responsive to the comparing means acts to at least prevent further loading of the compressor in response to a temperature differential of predetermined magnitude. Preferably, the control means constitutes a two-step control, which first blocks further loading of the compressor and which secondly initiates unloading of the compressor at a slightly higher temperature differential than that required to block further loading.

The means for comparing the ambient temperature to the saturated suction temperature of the refrigerant at the outlet of the outdoor coil and available to the compressor comprises a bellows means, and the control means comprises switch means responsive to bellows means movement for controlling the loading and unloading means of the compressor. The compressor may comprise a helical screw rotary compressor, and the capacity control means may constitute a slide valve. A hydraulic cylinder and piston assembly may be fixed to the slide valve for shifting the slide valve between extreme positions corresponding to full compressor loading and unloading, respectively. The system may comprise a source of hydraulic pressure fluid and load and unload solenoids for selectively supplying pressure fluid to and relieving such pressure fluid from chambers to the sides of the power piston within the cylinder to shift the slide valve to effect compressor loading and unloading. Said switch means may comprise a first, normally closed microswitch adjacent the bellows means and responsive to initial bellows means movement to disconnect a load solenoid connected thereto from its electrical source, and a second, normally opened microswitch within a circuit including an unload solenoid and said electrical source, such that upon displacement of the bellows means to a further degree, and the normally open microswitch closes to energize the unload solenoid and cause the hydraulic pressure fluid from the source to be directed to the power piston to shift the slide valve towards unload position under the second step of a two-step control.

The control device may incorporate third and fourth microswitches for initially preventing further unloading of the compressor by opening, in a first step, the circuit to the unload solenoid and subsequently, in a second step of the control operation, cause change of state closing of the fourth microswitch to close the electrical circuit between the source and the load solenoid valve, such that hydraulic pressure fluid directed to the power piston shifts the slide valve towards load position to effect some loading of the compressor to prevent liquid refrigerant logging of the evaporator coil.

DESCRIPTION OF THE PREFERRED EMBODIMENT

Figure 1:
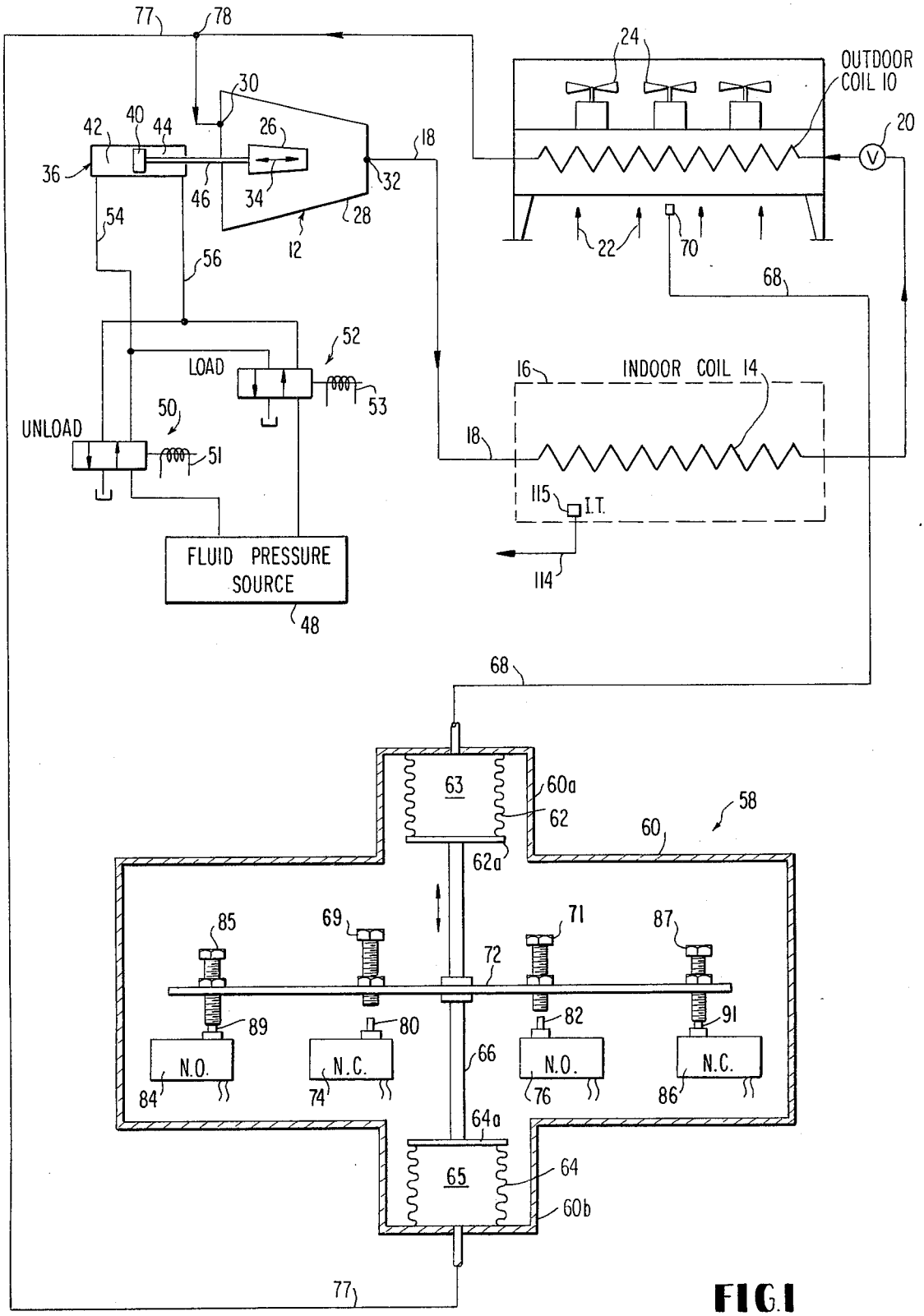
FIG. 1 is a hydraulic schematic circuit diagram of an air source, helical screw compressor, heat pump system incorporating the maximum and minimum evaporator $\Delta T$ control as one embodiment of the present invention.

The present invention is illustrated in conjunction with a heat pump system which incorporates a helical screw rotary compressor as an element thereof. However, the invention has equal application to air source heat pump systems involving other forms of compressors, such as reciprocating compressors and the like. The control scheme provided to the heat pump system, which is of typical construction, prevents extended operation of the heat pump system at differences between coil surface temperatures and ambient temperatures greater than that which is necessary for effective heating of the building or interior within which the indoor coil is positioned. In that respect, the principal components of the air source heat pump system of the present invention comprises an outdoor coil indicated generally at 10, a helical screw rotary compressor indicated generally at 12, which may be of the hermetic type and which may include within the hermetic casing an electric motor for driving the helical screw rotors, an indoor coil 14 which is provided within an enclosure or building 16 being conditioned; the compressor 12 being located intermediate of the outdoor coil 10 and the indoor coil 14. Conduit means indicated generally at 18 connect the outdoor coil 10, the compressor 12 and the indoor coil 16 in a closed series refrigeration loop in that order. For the purposes of illustration, the heat pump system is shown under conditions where it operates solely in a heating mode —that is, the outdoor coil 10 acts as the evaporator for the system and the indoor coil 14 acts as the condensor. A four-way valve or similar means is simply eliminated in this illustrated embodiment. As such, there is a requirement for a restriction within the conduit means 18 at the inlet to the outdoor coil 10 acting as the evaporator and the system incorporates a thermal expansion valve 20 for this purpose, although, obviously, a capillary tube or similar means could be provided. The conduit 18 carries a suitable refrigerant, such as R22, R500 or the like, with the refrigerant in vapor form being compressed by compressor 12 and discharged under high pressure where it condenses within the indoor coil 14, giving up heat to the interior or space within the enclosure 16 being conditioned. The condensed liquid refrigerant passes through conduit means 18 to the thermal expansion valve 20 where the refrigerant expands and absorbs heat which is removed from the air passing over the surfaces of the outdoor coil 10 as shown by arrows 22, this air flow being induced by means of a plurality of motor-driven fans indicated generally at 24. The compressor 12 is provided with capacity control means taking the form of a slide valve 26 which covers a portion of the compressor casing 28 and which controls the extent compression of the suction gas which enters the compressor at inlet 30 and which discharges at outlet 32, the slide valve being shiftable longitudinally, as indicated by the double-headed arrow 34. A shift to the right acts to unload the compressor while a shift to the left acts to load the compressor. This is achieved by a hydraulic piston and cylinder assembly indicated generally at 36, including a cylinder 38 within which piston 40 reciprocates, the piston defining a chamber 42 to the left and a chamber 44 to the right, the piston being connected mechanically to the slide valve by a mechanical connection such as shaft 46. Schematically, in order to effect loading and unloading of the compressor therefor, it is necessary to supply a pressurized fluid to one of the chambers 42 or 44 of the piston and cylinder assembly 36 and remove fluid from the opposite chamber, such as 44, and vice versa. For instance, to achieve unloading of the compressor, the pressurized fluid, such as hydraulic liquid, is fed to chamber 44, causing the piston to shift from right to left, with the slide valve moving towards the full load position, reached by slide valve 26 shifting to its leftmost position. Appropriate stops are provided for limiting the movement of the slide valve. Such apparatus is conventional, and also conventionally, solenoid operated valves are employed for controlling the connection between chambers 42 and 44 and a source of pressurized fluid, such as a hydraulic oil or the like, the source being indicated schematically at 48. In this respect, and for illustrative purpose only, there is shown an unload solenoid valve 50 and a load solenoid valve 52, the unload solenoid 50 being connecting by way of conduit means 54 to a fluid pressure source 48, which opens to chamber 42 of the piston and cylinder assembly 36. Similarly, the load solenoid 52 acts to connect the right-hand chamber 44 of the piston and cylinder assembly 36 to the source of fluid pressure 48 by way of conduit 56, carrying valve 52.

While the load and unload solenoid valves may be appropriately otherwise controlled by suitable means (not shown) to insure operation of the heat pump system in response to certain load conditions, such as by way of the temperature, for instance, within the enclosure 16 being conditioned and being controlled through a suitable thermostat (not shown) within that enclosure, the present invention is directed, in part, to a particular control scheme for insuring that the heat pump system will operate to prevent the saturated condensing temperature within the indoor coil 14, acting as a condensor for the system, from exceeding that which is necessary to adequately heat the enclosure 16 under steady-state conditions. In that regard, the system incorporates a special control device as at 58 which constitutes a closed casing or housing 60 carrying a first bellows 62 which spans across a portion **60*a* the housing and forms with housing portion 60*a*, a first chamber 63. A second chamber 65 is formed onto opposite side of the control device by housing portion 60*b* and a second bellows 64. The inner ends 62*a* and 64*a* of bellows 62 and 64, respectively, are interconnected by rod 66, which constitutes a means for comparing the pressures within the chambers 63 and 65. In that regard, the chamber 63 is connected by way of a capillary tube 68 to a bulb 70 which is mounted adjacent to the outdoor coil 10, within the air flow path of the ambient air 22 and preferably on the inlet side of that unit. Also, preferably, the bulb 70 is shielded from the sunlight so that it may truly sense the temperature of the ambient air available to the outdoor coil 10 for supplying heat to that coil under heat pump system heating mode. The bulb 70 is preferably charged with a refrigerant identical to that within the closed series refrigeration loop provided by conduit 18, such as R-500. Thus, the refrigerant charged bulb 70** will supply a variable saturated pressure (correlated to ambient temperature) which acts through the capillary tube 68 and by way of the upper chamber 63 on the bellows 62 to vary the set point of end 62*a* of that bellows as a function of the outdoor ambient air temperature feeding the system evaporator as provided by outdoor coil 10. The bellows 62 and 64 each have a spring constant. Alternatively, if the bellows are not of a spring material, they may house compression springs. Preferably, the spring constant is fixed, but set point may be adjustable to provide an adjustable spring load to an actuator bar or blade 72 fixed to rod 66 and extending at right angles thereto, intermediate of the ends of the rod. A conduit 77 connects chamber 65 of bellows 64 to conduit means 18 at point 78 intermediate of the outdoor coil 10 and inlet 30 to the compressor 12. Thus, chamber 65 is always subject to saturated suction pressure available to the compressor corresponding to the evaporating temperature of the refrigerant within the outdoor coil 10. A microswitch 74 is firstly mounted within casing 60 such that its actuator button 80 underlying an adjustment screw on blade 72 is somewhat more remote from that screw than an actuator button 82 carried by a second microswitch 76 from a second adjustment screw 71 carried by blade 72. Preferably, the actuator blade 72 extends beyond the microswitches 74 and 76, and the control system advantageously includes additional microswitches, as at 84 and 86 and the blade 72 carrying adjustment screws 85 and 87 which overly, respectively, actuator buttons 89 and 91 for microswitches 84 and 86. The adjustment screws 69, 71, 85 and 87 may be suitably, axially screwed to adjust their lower ends relative to the actuator buttons 80, 82, 89 and 91, respectively, for microswitches 74, 76, 84 amd 86. The rod 66 which extends axially between the bellows 62 and 64 constitutes the pressure comparing means for the control device 58. Therefore, depending upon the saturated vapor pressure of the refrigerant within bulb 70 and responsive to ambient temperature, and the saturated vapor pressure of the refrigerant at the suction side of the compressor, the blade 72 will shift towards or away from the fixed microswitches to effect depression or projection of the actuator buttons of the microswitches and a change of state of the microswitches.

Figure 2:
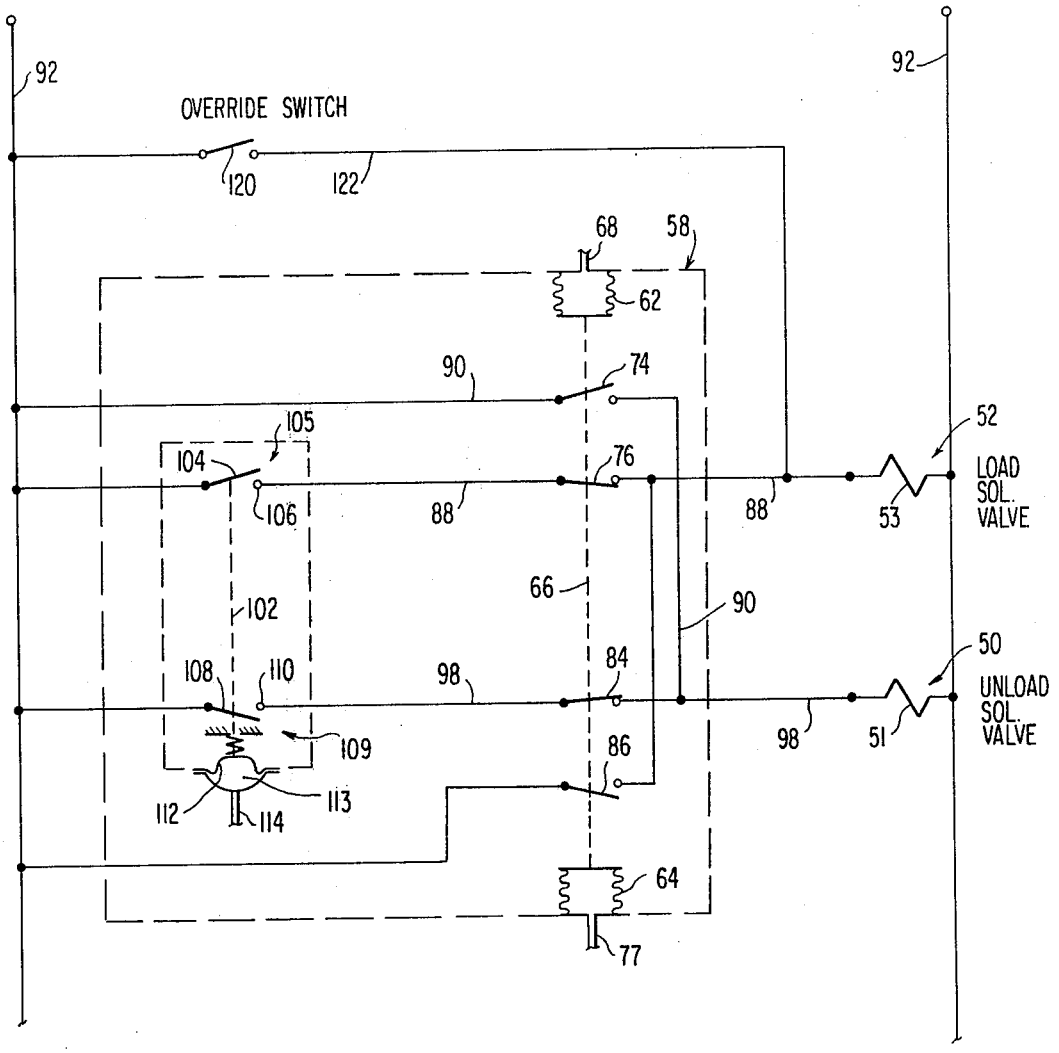
FIG. 2 is an electrical schematic diagram of the electrical control circuit employed in the illustrated embodiment of the invention of FIG. 1.

Referring to FIG. 2, microswitch 74 is connected in series electrically to coil 51 of the unload solenoid valve 50 by way of leads 90 and across an electrical source defined by lines 92. In turn, the microswitch 76 is connected by way of leads 88, in series with coil 53 of load solenoid valve 52 and across the voltage source. Microswitch 74 constitutes a normally open switch, while microswitch 76 constitutes a normally closed switch. In a typical system operation involving microswitches 74 and 76 alone, the control device 58 functions to prevent a maximum difference between the outside ambient air temperature and saturated suction temperature from being exceeded. As an example, if the air 22 flowing over the outdoor coil 10 is at 0° F., the saturated suction temperature of the refrigerant within line 18 available from the outdoor coil 10 for compression by compressor 12 should not be allowed to drop below −20° F. Under the same control at 20° ambient, the saturated suction should not be allowed to drop below 6° F., and at 40° ambient, the control device 58 should operate to prevent the saturated suction from dropping below 30° F. In contrast, with no controls, at a 40° ambient and a compressor operating under full load conditions, the saturated suction temperature may drop as low as −20° F., with 40° ambient air blowing over the outdoor coil 10. It is obvious that the efficiency of the system is destroyed under such conditions.

For instance, as the evaporating saturated suction pressure as seen within chamber 65 of bellows 64 falls 10 psi below the saturated pressure of the refrigerant provided by bulb 70 and sensed within chamber 63 at the opposite bellows 62, the rod will be shifted vertically downwards depressing adjustment screw 70 carried by blade 72 and actuator button 82 of the microswitch 76, causing that switch to shift from its normally closed contact condition to open contact condition and opening the circuit between the electrical source and coil 53 the load solenoid 52, thus preventing further loading of the compressor by preventing the pressure fluid from passing from source 48 to chamber 44 and shifting the slide valve further, from right to left.

As the system continues to operate and the evaporating pressure tends to fall even further within the outdoor coil 10, a further pressure drop will be experienced within chamber 65 and the bellows 65 will contract even further, causing blade 72 to be depressed further, to the extent that adjustment screw 68 depresses button 80 to change the state of microswitch 74 from normally open contact condition to closed contact condition, thus closing the circuit from the power source via lines 98 to coil 51 of the unload solenoid valve 50. This permits pressure fluid to be directed to chamber 42 through line 56 and causing the piston 40 to shift towards the right to unload the compressor by shifting the slide valve 26 to the right.

From the above, it is evident that the control device 58 will function such that the differential sensing element —that is, the rod 66 and blade 72— will always actuate the microswitches dependent upon the temperature differential. However, in a very cold ambient, it will allow a significant temperature differential to exist, while in a mild ambient, there will only be allowed a very mild temperature differential prior to effecting a control action. This is completely opposite of normal compressor system characteristics. For instance, if the compressor, absent the control device, were to run fully loaded in a very cold ambient, there would be a high differential. If the compressor were to run fully loaded in a mild ambient, the differential increases massively, leading to high system inefficiency. Thus, the control device totally elimintes the normal characteristics of the compressor under given ambient conditions, and the device may function as a basic control element for application to helical screw compressor to heat pump systems incorporating helical screw rotary compressors, other types of rotary compressors, or reciprocating compressors and may be readily applied to force unloading of the compressor or to limit further loading and blocking other controls which might be compelling the machine to load.

Turning again to FIG. 1, microswitches 84 and 86, which underly blade 72 within the control device 58 are likewise sensitive to movement of blade 72. As may be seen in FIG. 2, in this respect, the microswitch 84 is a normally open contact switch and microswitch 86 is a normally closed contact switch. However, adjustment screws 85 and 87 are screwed downwardly with respect to the blade or bar 72 to which they are threaded to the extent that the adjustment screw 85 maintains the actuator button 89 of microswitch 84 in its depressed state, while adjustment screw 87 maintains the actuator button 91 of the microswitch 86 in its depressed state. With microswitch 84 being a normally open switch, its switch contacts, under normal circumstances, with the control system between the set points of a two-step thermostat IT within the space or room being conditioned, as at 16 in FIG. 1, are held closed and a circuit is completed to the unload solenoid valve coil 51, while the depression of the actuator button 91 of microswitch 86, which is a normally closed switch, maintains the switch contacts open and an open circuit exists, including microswitch 86 and coil 53 of the load solenoid valve 52. Microswitches 84 and 86, therefore, have their states changed in response to an increase in the evaporator pressure as sensed by bellows 64 through line 77 leading to the suction side of the compressor relative to the reference pressure of bellows 62 as defined by the refrigerant filled bulb 70. As the evaporator pressure rises within chamber 65 of bellows 64 relative to chamber 63 of bellows 62, the rod 66 moves vertically upward, causing the bar or blade 72 to move away from the multiple microswitches. This movement reaches the extent where the adjustment screws 85 and 87 rise to cause the microswitch actuator buttons 89 and 91, respectively, to project to the extent of changing the state of the switch contacts of switches 84 and 86. The microswitch 84 is connected by way of leads 51 to coil 51 of the unload solenoid valve 50 and across the control voltage source via lines 86, such that projection of the actuator button 89 causes the contacts of microswitch 84 which previously have been maintained closed to open, thus opening the circuit from the voltage source to the unload solenoid valve coil 51 and thereby preventing furthe unloading of the compressor. Upon continued movement of the rod 66 and blade 72 upwardly, due to a further increase in pressure within chamber 65 relative to that within chamber 63 because the saturated vapor pressure of the refrigerant within conduit 77 and line 18 extending from the outdoor coil to the suction or inlet side of compressor 12 increases above the saturated vapor pressure of the refrigerant within bulb 70 and available to chamber 62, the plunger or actuator button 91 of the microswitch 86 projects to the point where the switch contacts of microswitch 86 change state. The normally closed contact which have been maintained open by the adjustment screw 87 pressing on the microswitch actuator button 91 now close, and a circuit is completed through leads 100 to the coil 53 of the load solenoid valve 52, causing the compressor to load even though the other parameters of the system are calling for compressor unloading. Thus, the function of the control device 58 in this instance is to prevent liquid logging of the evaporator outdoor coil 10 by way of accumulation of a large quantity of liquid refrigerant within the outdoor coil 10 and leading to the inlet or suction port 30 of compressor 12. As may be appreciated, therefore, the single refrigerant bearing bulb 70 supplied along with line 77 control input signals to the control device 58 for actuation selectively of four different microswitches to insure high system efficiency under heating mode conditions, both low ambient temperature conditions and high ambient temperature conditions. Obviously, microswitches 84 and 86 could be placed on the opposite side of the blade or bar 72, with the adjustment screws 85 and 87 being threaded from the bottom towards the top of device 58, whereby the change of state for microswitches 84 and 86 would be accomplished by depression of microswitch actuator buttons 89 and 91 rather than a relaxation or projection of those buttons by movement of the adjustment screws away from the microswitches under the illustrated embodiment of the invention.

As mentioned previously, the control device 58 incorporates additional switches within lines 88 and 98 to effect normal load and unload operation of the compressor in response to temperature change with the enclosure 16 being conditioned. This causes the sets of dual microswitches 74-76 and 84-86 to operate under a two-step control scheme. In this respect, a mechanical switch actuator rod, as at 102, is mechanically coupled to a first movable switch contact 104 which opens and closes with respect to a fixed contact 106 for a first switch 105 within line 88 and between the microswitch 76 and one of the control voltage lines 92. A movable switch contact 108 is fixed to the opposite end of the rod 102 which contact 108 opens and closes with respect to fixed contact 110 of a second switch 109. The contacts 104 and 106, therefore, define a first thermostat operated switch 105 and switch contacts 108 and 110 define a second thermostat operated 109. Switch 109 is located within line 98 and between the microswitch 84 and one line 92 of the control voltage source. Schematically, the thermostat constitutes a pressure responsive diaphragm forming a part of a chamber 13 carrying an expandible fluid. Rod 102 is fixed to the center of diaphragm 112 and moves vertically therewith. Chamber 113 is connected to a thermo bulb 115 forming a part of indoor thermostat 17 within enclosure 16 by a capillary tube 114 with chamber 113, tube 114 and bulb filled with a heat expansible fluid. As the temperature in the enclosure 16 increase, the rod 102 of control device 58 moves vertically upwardly; as the temperature decreases, rod 102 moves downwardly. Obviously, other types of thermostats may be employed in lieu thereof.

Thus, switch 105 functions in a normal sense to control the heating of the space within enclosure 16 being conditioned by causing opening of the load solenoid valve 52 by energization of the load solenoid valve coil 53 with absence of override provision of blade 72 and the pressure differential existing between chambers 63 and 65 of bellows 62 and 64. If the temperature within the room or space 16 being conditioned drops below a predetermined value, the switch contact 104 closes on fixed switch contact 106, and the compressor loads to cause an increase in refrigerant flow through the system and to the indoor coil. Likewise, switch 109 functions in response to a temperature increase above a predetermined set point within the enclosure 16 as sensed by the indoor thermostat IT. However, obviously, the thermostat operated rod 102 will have caused contacts 104 and 106 of switch 105 to open prior to closure of movable contact 108 onto the fixed contact 110 of switch 109 and energization of the unload solenoid valve coil 51 for unloading of the compressor. The microswitches 74, 76, 84 and 86, therefore, act as an override to the normal control via the load and unload solenoid valves 52 and 50, respectively. In that regard, the minimum $\Delta T$ block comes into play when the compressor unloading is dictated. If the evaporator pressure rises too high relative to the reference ambient pressure, unloading is blocked; and if further rise occurs, loading is initiated. At this point, the pressure is again in check, loading terminates and the compressor is then banded in a guaranteed flow condition responsive to further operating parameters depending upon change in load conditions. Conversely, if excessive loading occurs, the loading block comes into play when the evaporator pressure drops too far relative to the reference ambient pressure (temperature). In this case, microswitch 76 changes state to open contact condition, preventing energization of the load solenoid valve. Subsequently, if a further drop occurs, in the evaporator pressure or if the rise in the referenced pressure (temperature) occurs, microswitch 74 has its normally open contacts closed, resulting in energization of the coil 51 of the unload solenoid valve 50 to unload the compressor until the preset parameters are again in balance.

A typical setting for the microswitches as determined by the spring constants of the bellows and the position of adjustment screws 68, 70, 85 and 87 and responsive to given system parameters are provided by the table below.

| VARIABLE ΔP BLOCK-BELOW SET POINT Assume 20° F. Ambient 21.0 psig R-12 | | | | |
|---|---|---|---|---|
| STEP | FUNCTION | ΔP | COIL PSIG | °F. COIL |
| 1 | Load Block Off | 7.25 psi | 13.75 | 8.5° F. |
| 1 | Load Block On | 7.50 psi | 13.50 | 8.0° F. |
| 2 | Unload Force Off | 10.75 psi | 10.25 | 2.0° F. |
| 2 | Unload Force On | 11.25 psi | 9.75 | 1.0° F. |
| VARIABLE ΔP BLOCK-ABOVE SET POINT | | | | |
| STEP | FUNCTION | ΔP | COIL PSIG | °F. COIL |
| 1 | Unload Block On | 6 psi | 15.0 | 11° F. |
| 1 | Unload Block Off | 6.5 psi | 14.5 | 10° F. |
| 2 | Load Force On | 4 psi | 17.0 | 14° F. |
| 2 | Load Force Off | 4.5 psi | 16.5 | 13° F. |

It may be appreciated that the bellows 62 and 64 may be formed appropriately of a metal having a given spring constant, and provide between full compression and expansion a differential pressure range which may vary from 0 to 6 psi to as high as 0 to 70 psi. In that regard, the bellows may comprise brass, phosphor bronze or stainless steel, obviously, the stainless steel providing the higher spring constant. Referring to the table above, under an assumed 20° F. ambient and utilizing R-12 as the refrigerant for the system and for bulb 70, as the pressure differential increases to 7.50 psi, load blocking is effected by opening of microswitch contacts for microswitch 76, thus taking coil 53 of the load solenoid valve 52 off the line. If, for any reason, the evaporator pressure continues to go down, the differential increases and, at the point that 11.25 psi differential exists between chambers 62, 63 and 65, the further depression of the blade or bar 72 results in the change of state for microswitch 74, with the switch contacts closed and with the resultant energization of the coil 51 of the unload solenoid valve 50. Unloading of the compressor 12 is initiated, with unloading ceasing when the pressure differential drops to 10.75 psi. Based on parameters within the space being conditioned, if the pressure differential drops to 7.2 psi or if the coil pressure rises to 13.75 psi, then the load block is removed; if the unit is still operating in the below set point condition, loading commences. However, assuming that the system is no longer operating in the below set point condition but in the above set point condition, the circuit to coil 51 of the unload solenoid valve 50 is open when the pressure differential reaches 6 psi. If the pressure differential continues to fall to 4 psi even though unloading has terminated, loading will be commenced by energization of the circuit through microswitch 86 to the coil 53 of load solenoid valve 52, causing the machine to start to load-up until a 4.5 psi differential is established, then loading is terminated. However, if this does not occur and the pressure differential builds up from 6 psi to 6.5 psi, then the unload block is removed; if the system is still operating in the above set point condition, unloading will commence until the differential is again dropped to 6 psi. This is a fine control, and the slide valve is in all reality locked in a very limited range. Thus, it may be appreciated that the ΔT type of control as provided by the present invention is one in which the compressor operation is for all practical purposes continuous. By way of the type of floating, unloading limit, the compressor on/off cycling is greatly reduced, and the floating, loading block, in the same manner, prevents over-running of the heat exchangers under conditions of relatively mild heating requirements.

From the above, it may be obvius that at certain times it would be desirable to override the variable ΔT control as, for instance, in a morning pull-up condition for a building or residence which requires more heat during the day than during the night. This may be accomplished automatically. However, by reference to FIG. 2, it can be seen that the present invention provides a simple manually operated override switch 120 in a line 122 which is in parallel with line 88, and permits energization of the load solenoid valve coil 53 indifference to energization through the various microswitches or switches 105 and 109 under thermostatic control. Closure of the single pull, single throw switch 120 completes the circuit between control voltage lines 86 to the coil 53. Thus, the loading limit block is cut out of the circuit for a manually determined period of time. Further, instead of a thermo bulb providing the means for shifting the movable contacts 108 and 104 for valves 105 and 109, it is obvious that a bi-metal strip may be employed within the thermostat, which bi-metal strip is exposed to ambient and incorporates on it two hermetically sealed glass cylinders partially filled with liquid mercury. The glass cylinders are provided with spaced contacts which are closed by shift in the mercury from one side of the cylinder to the other under predetermined temperature differential conditions, which would come about as the bi-metal heats up or cools down. One of the glass cylinders tips at a given first temperature for the low temperature setting of the two-step thermostat, while the other glass cylinder tips at a higher temperature, with the temperature differential being determined by the two tip points. The first and second set points of the thermostat are adjustable with respect to each other as well as with respect to room temperature. This type of two-stage room thermostat is commercially available from the Minneapolis Honeywell Corporation or the like.

It is obvious to one skilled in the art that this invention also applies to a water (or fluid) source heat pump as well. In the general case, the entering water (fluid) temperature becomes the reference which the evaporating temperature is measured against. It is also obvious that the system described pertains to refrigeration systems as well as heat pump systems. A refrigeration system, of couse, is a heat pump in the absolute sense of the term, as heat is pumped from the refrigerated area to the area where the heat is being rejected.

While the invention has been particularly shown and described with reference to a preferred embodiment thereof, it will be understood by those skilled in the art that various changes in form and details may be made therein without departing from the spirit and scope of the invention.

What is claimed is:

1. In an air source heat pump system of the type including a first heat exchanger forming an indoor coil, a second heat exchanger forming an outdoor coil and positioned in an ambient air flow, a compressor, and conduit means carrying a refrigerant and connecting said compressor between said coils and in a closed series loop, an expansion means provided within the conduit means adjacent to the inlet end of the outdoor coil to permit the outdoor coil to act as an evaporator when the system is in the heating mode, and wherein means are provided for loading and unloading the compressor to vary the capacity of the compressor and the system compression ratio, the improvement comprising:

(a) temperature sensing means positioned adjacent the outdoor coil and within the ambient air flow passing over the outdoor coil;

(b) means for sensing the evaporating temperature of the refrigerant available to the compressor from the outdoor coil; and (c) control means operatively connected to said sensing means and responsive to a predetermined temperature decrease of evaporating temperature below ambient temperature for at least preventing further loading of the compressor, thereby tending to prevent the outdoor coil surface temperature from dropping below the dew point and virtually eliminating frosting of said outdoor coil.

2. The air source heat pump system as claimed in claim 1 wherein said control means comprises means for controlling the loading and unloading means of the compressor and responsive to a predetermined rise in temperature of the evaporating refrigerant available to the compressor toward ambient to block said means for unloading the compressor to prevent further unloading of the compressor, and responsive to a slightly higher temperature rise of suction refrigerant toward ambient to cause operation of said means for loading the compressor to initiate compressor loading.

3. The air source heat pump system as claimed in claim 1, wherein said control means constitute first means in response to a predetermined temperature drop of the evaporating temperature of the refrigerant available to the compressor toward ambient temperature to a predetermined degree for controlling said means for loading the compressor to initially block further loading of the compressor, second means to initiate unloading of the compressor at a slightly further decrease in the evaporating temperature of the refrigerant toward that of ambient, third means responsive to initial rise of evaporating temperture towards ambient to a predetermined degree for initially controlling said unloading means for blocking unloading of said compressor, and fourth means for controlling said compressor loading means to initiate loading of the compressor when the evaporating temperature rises further with respect to the ambient temperature above that which initiates operation of said unload blocking means, and to thereby prevent logging of the outdoor coil.

4. The air source heat pump system as claimed in claim 2 wherein said control means comprises means for comparing the ambient temperature to the evaporating temperature of the refrigerant available to the compressor from the outdoor coil, said comprising means comprises spring-biased bellows means, and said control means further comprises switch means responsive to bellows means movement for controlling the loading and unloading means of said compressor.

5. The air source heat pump system as claimed in claim 3 wherein said control means comprises means for comparing the ambient temperature to the saturated suction temperature of the refrigerant available to the compressor from the outdoor coil, said comparing means comprises spring-biased bellows means, and said control means further comprises switch means responsive to bellows means movement for controlling the loading and unloading means of said compressor.

6. The air source heat pump system as claimed in claim 4 wherein said compressor comprises a helical screw rotary compressor, said capacity control means comprises a capacity control slide valve for said compressor, a hydraulic cylinder and piston assembly is operatively coupled to said slide valve for shifting the slide valve between extreme positions corresponding to full compressor loading and unloading, said system comprises a source of hydraulic pressure fluid, load and unload solenoid valves for selectively supplying and relieving said fluid pressure to chambers to respective sides of a power piston within the cylinder to shift said slide valve towards and away from said extreme positions, an electrical voltage source, and said switch means comprises a first switch operatively mounted adjacent said bellows means and being responsive to an initial bellows means movement to disconnect the load solenoid valve from said electrical voltage source, and a second switch operatively positioned with respect to said bellows means and responsive to further movement of said bellows means from its initial movement position in the same direction for connecting said unload solenoid valve to said electrical voltage source, whereby, operation of said first switch prevents energization of the load solenoid valve and loading of the compressor, while subsequent operation of said second switch effects energization of the unload solenoid valve to direct hydraulic pressure fluid through said unload solenoid valve to said cylinder and piston assembly to inititate unloading of the compressor.

7. The air source heat pump system as claimed in claim 5 wherein said compressor comprises a helical screw rotary compressor, said capacity control means comprises a capacity control slide valve for said compressor, a hydraulic cylinder and piston assembly is operatively coupled to said slide valve for shifting the slide valve between extreme positions corresponding to full compressor loading and unloading, said system comprises a source of hydraulic pressure fluid, load and unload solenoid valves for selectively supplying and relieving said fluid pressure to chambers to respective sides of a power piston within the cylinder to shift said slide valve towards and away from said extreme positions, an electrical voltage source, and said switch means comprises a first switch operatively mounted adjacent said bellows means and being responsive to an initial bellows means movement and responsive to initial movement of said bellows means to disconnect the load solenoid valve from said electrical voltage source, and a second switch operatively positioned with respect to said bellows means and responsive to further movement of said bellows means from its initial movement position in the same direction for connecting said unload solenoid valve to said electrical voltage source, whereby operation of said first switch prevents energization of the load solenoid valve and loading of the compressor while subsequent operation of said second switch effects energization of the unload solenoid valve to direct hydraulic pressure fluid through said unload solenoid valve to said cylinder and piston assembly to initiate unloading of the compressor.

8. The air source heat pump system as claimed in claim 7 wherein said control means further comprises a third switch operatively positioned with respect to said bellows means and responsive to an initial movement of said bellows means to a predetermined degree in opposition to the direction of movement causing operation of said first switch, for disconnecting the unload solenoid valve from said electrical voltage source, and a fourth switch operatively positioned with respect to said bellows means and responsive to further movement of said bellows means from the position causing actuation of said third switch and in the same direction, for connecting said load solenoid valve to said electrical voltage source and for initiating compressor loading to thereby prevent logging of the outdoor coil when the evaporating temperature closely approaches ambient temperature.

9. The air source hat pump system as claimed in claim 8 wherein said indoor coil is mounted within an enclosure for conditioning the enclosure space, and said system further comprises a two-step thermostat having a below set point normally open switch and an above set point normally open switch with said below set point and above set point switches closing in sequence as the temperature within the space to be conditioned rises and defining an enclosure temperature differential therebetween, and means for connecting said below set point switch in series with said second switch means and said load solenoid valve and across said voltage source and said above set point switch being connected in series with said third switch and said unload solenoid valve and across said voltage source, such that the temperature of said space is modulated between said set point conditions by energizing said load solenoid valve when the space temperature decreases below the set point condition of said first set point valve and said above set point switch effects operation of said unload solenoid valve and unloads the compressor when the temperature within the enclosure reaches a predetermined temperature above the below set point condition, and wherein said first, second, third and fourth switches constitute overrides for the two-step thermostat.

10. The air source heat pump system as claimed in claim 9 further comprising an override switch for selectively connecting said load solenoid valve across said voltage source to permit quick pull-up space temperature by operating the compressor under full load and energization of the load solenoid valve in deference to said control operation provided by said first, second, third and fourth switches and said above and below set point switches.

* * * * *